US006516567B1

(12) United States Patent
Stone et al.

(10) Patent No.: US 6,516,567 B1
(45) Date of Patent: Feb. 11, 2003

(54) POWER ACTUATOR FOR LIFTING A VEHICLE LIFT GATE

(75) Inventors: Bruce Stone, Waterford, MI (US); Michael Turk, Waterford, MI (US); Jeffrey Kolar, Livonia, MI (US); Jose Garcia, Troy, MI (US); Dennis Reid, Rochester, MI (US)

(73) Assignee: Hi-Lex Corporation, Battle Creek, MI (US)

( * ) Notice: Subject to any disclaimer, the term of this patent is extended or adjusted under 35 U.S.C. 154(b) by 0 days.

(21) Appl. No.: 09/766,179

(22) Filed: Jan. 19, 2001

(51) Int. Cl.[7] ..... E05F 11/24
(52) U.S. Cl. ..... 49/343; 49/337; 296/55
(58) Field of Search ..... 49/337, 339, 340, 49/343; 296/55

(56) References Cited

U.S. PATENT DOCUMENTS

| | | | | |
|---|---|---|---|---|
| 677,894 | A | 7/1901 | Norton | |
| 868,409 | A | * 10/1907 | Cartland et al. | 49/339 |
| 2,306,575 | A | * 12/1942 | Tuttle | 296/107.17 |
| 2,366,613 | A | 1/1945 | Hagstrom | |
| 2,385,642 | A | 9/1945 | Peterson, Jr. | |
| 2,540,538 | A | * 2/1951 | Matchett | 49/340 |
| 2,594,643 | A | 4/1952 | Gustisha | |
| 2,768,532 | A | * 10/1956 | Russell | 74/424.75 |
| 2,770,454 | A | 11/1956 | Turtle | |
| 2,802,428 | A | 8/1957 | Redyard, Jr. | |
| 3,022,108 | A | 2/1962 | Cooley | |
| 3,134,112 | A | * 5/1964 | Hage | 114/361 |
| 3,202,414 | A | * 8/1965 | Simmons et al. | 49/280 |
| 3,274,732 | A | * 9/1966 | Murakami | 49/280 |
| 3,320,698 | A | * 5/1967 | Hummel | 49/340 |
| 3,398,484 | A | * 8/1968 | Katsumura et al. | 49/138 |
| 3,479,767 | A | * 11/1969 | Gardner et al. | 49/280 |
| 3,713,472 | A | 1/1973 | Dozois et al. | |
| 3,747,271 | A | 7/1973 | Adamski | |
| 3,991,523 | A | 11/1976 | Isaacson | |
| 4,026,071 | A | 5/1977 | Sessa | |
| 4,186,521 | A | 2/1980 | Hunter | |
| 4,186,524 | A | 2/1980 | Pelchat | |
| 4,186,665 | A | 2/1980 | deJong et al. | |
| 4,263,978 | A | 4/1981 | Jackson | |
| 4,598,496 | A | 7/1986 | VanDaele | |
| 4,735,029 | A | 4/1988 | Murphy | |

(List continued on next page.)

*Primary Examiner*—Gregory J. Strimbu
(74) *Attorney, Agent, or Firm*—Young & Basile, P.C.

(57) ABSTRACT

A power actuator for lifting a pivotal lift gate closing an access opening in a motor vehicle body. The actuator includes a lower tubular housing; a lead screw having a lower head portion journaled in a lower portion of the tubular housing and a threaded shaft portion extending upwardly from the head portion within the tubular housing; a tubular extender rod positioned slidably and telescopically within the tubular housing in concentric surrounding relation to the shaft portion of the lead screw and including a nut structure proximate a lower end thereof threadably engaging the shaft portion of the lead screw; a pivotal mounting structure on the lower end of the tubular housing to pivotally mount the lower end of the tubular housing to a side edge of the access opening; a pivotal mounting structure on the upper end of the tubular extender rod for pivotally mounting the extender rod to the lift gate; an electric motor positioned on the motor vehicle body proximate the access opening; and a flexible cable extending from the output of the motor and passing through an aperture in the lower end of the tubular housing for driving engagement with the head portion of the lead screw. The cable is mounted for rotation about a lengthwise axis of the cable whereby actuation of the motor moves the tubular extender rod axially relative to the tubular housing and provides opening or closing movement of the gate.

19 Claims, 5 Drawing Sheets

U.S. PATENT DOCUMENTS

| | | | | | |
|---|---|---|---|---|---|
| 4,735,292 | A | | 4/1988 | Munz | |
| 4,821,456 | A | | 4/1989 | Nogaki | |
| 4,903,435 | A | | 2/1990 | Bittmann et al. | |
| 4,934,203 | A | * | 6/1990 | Bailey et al. | 74/89.35 |
| 4,941,284 | A | | 7/1990 | Stoller | |
| 5,018,303 | A | | 5/1991 | Koura et al. | |
| 5,025,591 | A | | 6/1991 | DeLand et al. | |
| 5,046,283 | A | | 9/1991 | Compeau et al. | |
| 5,137,294 | A | | 8/1992 | Martin | |
| 5,140,771 | A | | 8/1992 | Moy et al. | |
| 5,147,106 | A | | 9/1992 | Bartelt et al. | |
| 5,316,365 | A | | 5/1994 | Kuhlman et al. | |
| 5,323,570 | A | | 6/1994 | Kuhlman et al. | |
| 5,367,826 | A | | 11/1994 | Wu | |
| 5,396,158 | A | | 3/1995 | Long et al. | |
| 5,442,879 | A | | 8/1995 | Christensen | |
| 5,448,856 | A | | 9/1995 | Moore et al. | |
| 5,507,120 | A | * | 4/1996 | Current | 49/340 |
| 5,588,258 | A | | 12/1996 | Wright et al. | |
| 5,765,308 | A | | 6/1998 | Anderson et al. | |
| 5,804,937 | A | | 9/1998 | Sasajima et al. | |
| 5,804,938 | A | * | 9/1998 | Richmond et al. | 318/282 |
| 5,865,497 | A | | 2/1999 | Klein et al. | |
| 5,873,200 | A | | 2/1999 | Henderson | |
| 6,055,775 | A | * | 5/2000 | Dering et al. | 49/340 |
| 6,115,965 | A | * | 9/2000 | Jennings | 49/334 |
| 6,185,868 | B1 | * | 2/2001 | Kato | 49/339 |

* cited by examiner

POWER ACTUATOR FOR LIFTING A VEHICLE LIFT GATE

BACKGROUND OF THE INVENTION

This invention relates to power actuators and more particularly to a power actuator for lifting a pivotal lift gate closing an access opening in a motor vehicle body.

Motor vehicles of the hatchback and van configuration typically include an access opening at the rear of the vehicle body and a lift gate selectively opening and closing the access opening. The lift gate is typically manually operated and specifically requires manual effort to move the gate between open and closed positions. Various attempts have been made to provide power actuation for the lift gate but none of the prior art power actuation systems have realized any significant degree of commercial success since they have either been unduly complicated, relatively expensive, or maintenance prone.

SUMMARY OF THE INVENTION

This invention relates to a power actuator for lifting a pivotal lift gate closing an access opening in a motor vehicle body.

According to the invention, the power actuator comprises a motor assembly adapted to be secured to the motor vehicle body proximate the access opening; a rotary flexible cable having a driven end driven by the motor assembly and a driving end; and an extensible strut including an upper mounting structure proximate an upper end of the strut for pivotally mounting the upper end of the strut to the lift gate, a lower mounting structure proximate a lower end of the strut for pivotally mounting the lower end of the strut to the motor vehicle body proximate the access opening, means proximate the lower end of the strut for receiving the driving end of the cable, and means for extending the strut in response to rotation of the cable by the motor assembly whereby to raise the gate in response to actuation of the motor assembly. This arrangement provides a simple, effective, and relatively inexpensive system for raising and lowering the gate.

According to a further feature of the invention, the extensible strut includes a lower tubular housing member, a lead screw mounted for rotation in the tubular housing member and including a lower head portion journaled in a lower portion of the tubular housing member and an upper threaded shank portion, and a tubular extender rod telescopically and slidably positioned in the tubular housing member in concentric surrounding relation to the lead screw shaft portion and including a nut structure at a lower end thereof threadably receiving the lead screw shaft portion; the lower mounting structure is provided proximate the lower portion of the tubular housing member; and the upper mounting structure is provided proximate an upper end of the tubular extender rod. This arrangement provides a simple and compact strut construction for effecting the raising and lowering of the gate.

According to a further feature of the invention, the lower portion of the tubular housing member defines a cavity; the head portion of the lead screw is journaled in the cavity; the receiving means includes an aperture in a lower end of the tubular housing member communicating with the cavity; the driving end of the cable passes through the aperture and drivingly engages the head portion of the lead screw; and the extending means is constituted by the threaded engagement of the lead screw shaft portion with the nut structure. This specific construction provides an effective arrangement for extending the strut in response to rotation of the cable.

According to a further feature of the invention, the actuator further includes bearing means positioned in the cavity and journaling the lead screw head portion. This arrangement facilitates the smooth rotation of the lead screw within the housing member.

According to a further feature of the invention, the motor assembly includes an electric motor and a speed reducer driven by the motor. This arrangement allows the use of readily available motor and speed reducer assemblies to provide the motor power for the actuator.

According to a further feature of the invention, the threads of the lead screw shaft portion and the nut structure have a pitch angle of at least 20°. This specific arrangement enables the lead screw to spin relatively freely in the nut structure as the gate is raised and lowered manually so as to offer minimal resistance to the manual raising and lowering of the gate.

According to a further feature of the invention, the motor assembly includes a clutch downstream of the motor effective to drive the cable from the motor but ineffective to drive the motor from the cable. This arrangement avoids back driving of the motor in response to manual operation of the lift gate.

The invention also provides an improved actuator for providing relative movement between first and second structures. The improved actuator comprises a lower tubular housing; a lead screw having a lower head portion journaled in a lower portion of the tubular housing and a threaded shaft portion extending upwardly from the head portion within the tubular housing; a tubular extender rod positioned slidably and telescopically within the tubular housing in concentric surrounding relation to the shaft portion of the lead screw and including a nut structure proximate a lower end thereof threadably engaging the shaft portion of the lead screw; a mounting structure on the tubular housing for mounting the tubular housing on the first structure; a mounting structure on the tubular extender rod for mounting the tubular extender rod on the second structure; and a drive mechanism engaging the head portion of the lead screw and operative to rotate the lead screw relative to the tubular housing whereby to move the tubular extender rod axially relative to the tubular housing and provide relative movement between the first and second structures. This actuator construction provides a simple, effective, and inexpensive actuator for providing movement between two structures.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
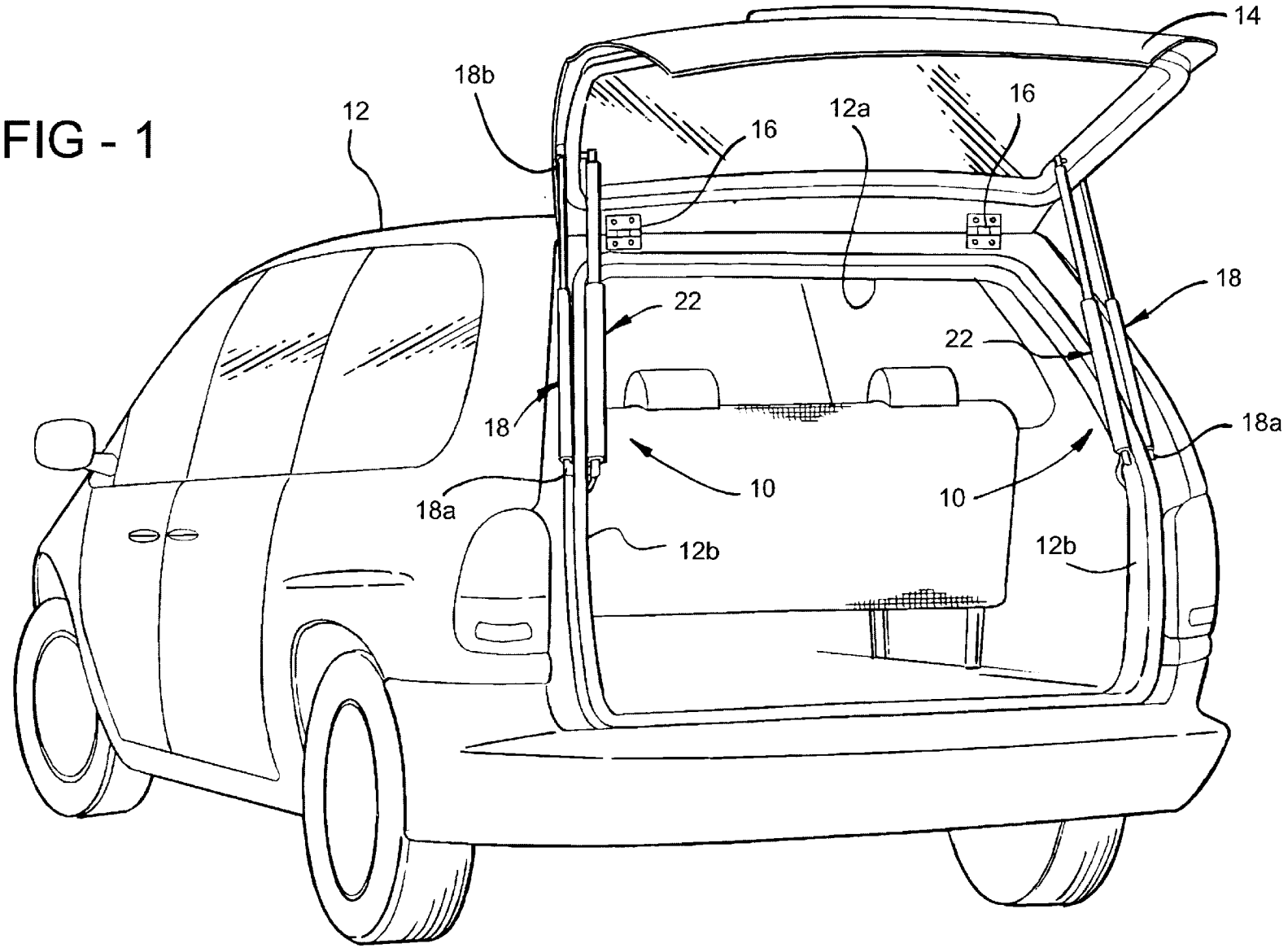
FIG. 1 is a perspective rear view of a motor vehicle of the van type including a lift gate controlled by a power actuator according to the invention.
Figure 2:
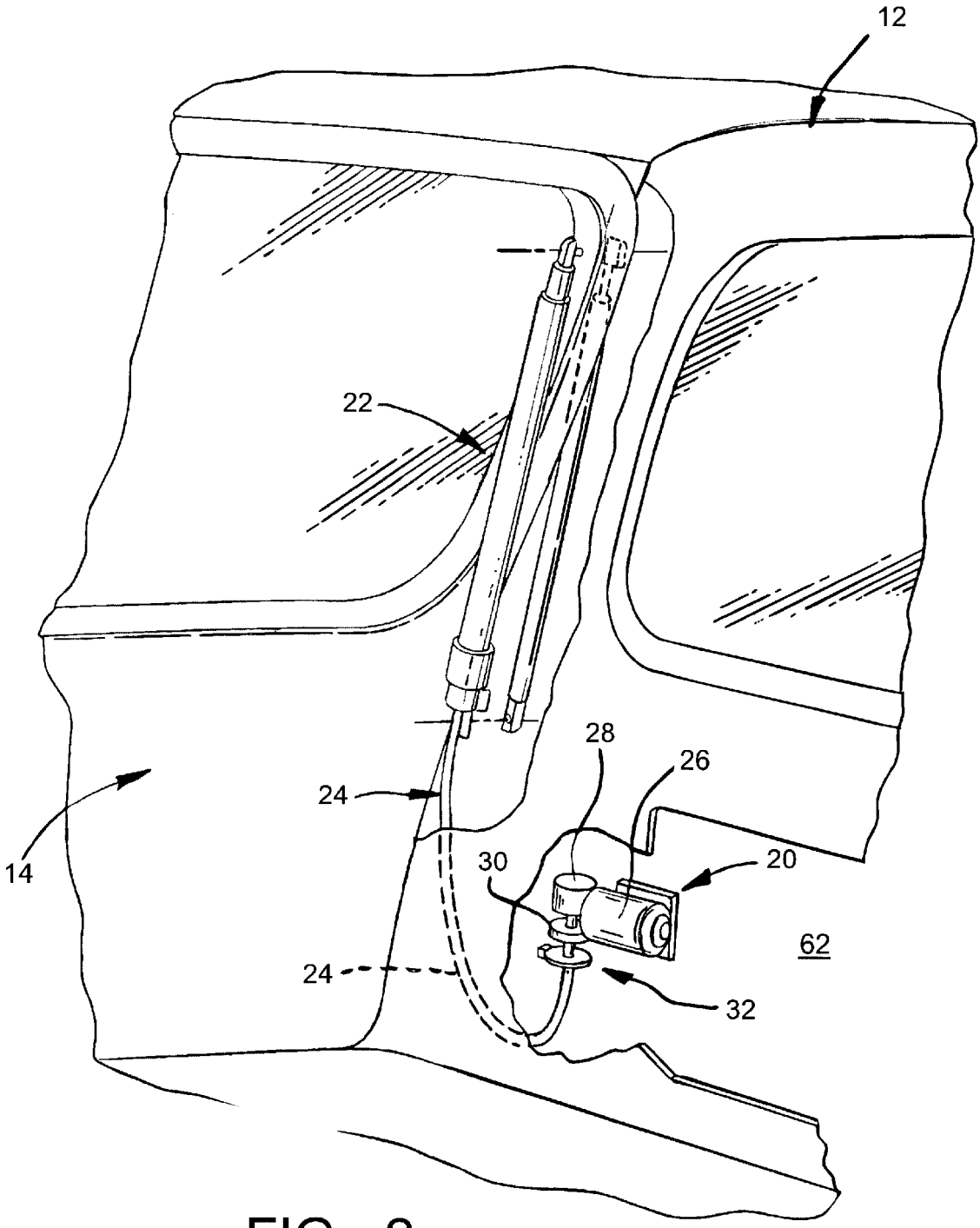
FIG. 2 is a fragmentary interior view of the motor vehicle seen in FIG. 1 looking toward the rear of the vehicle.

The power actuator 10 of the invention is seen in FIGS. 1 and 2 in association with a motor vehicle of the type including a body structure 12 defining a rear access opening 12*a,* a tailgate or lift gate 14 pivotally mounted to body structure 12 by a hinge structure 16 for pivotal movement about the axis of hinge structure 16 between a raised position seen in FIG. 1, allowing access to the interior of the vehicle through the access opening 12*a,* and a closed position seen in FIG. 2 closing the access opening.

A pair of gas struts or springs 18 of known form are provided at opposite sides of the opening 12*a*. Each strut extends from a lower pivotal mounting point 18*a* proximate a vertical side edge 12*b* of the opening and an upper pivotal attachment point 18*b* on the lift gate at a location spaced from the hinge axis. Gas struts 18 assist in manual operation of the lift gate 14 and maintain the lift gate in a pivoted fully open position against the weight of the tailgate. A power actuator 10 is provided in association with each gas strut 18.

Each power actuator 10, broadly considered, includes a motor assembly 20, a strut assembly 22, and a flexible cable assembly 24.

Figure 7:
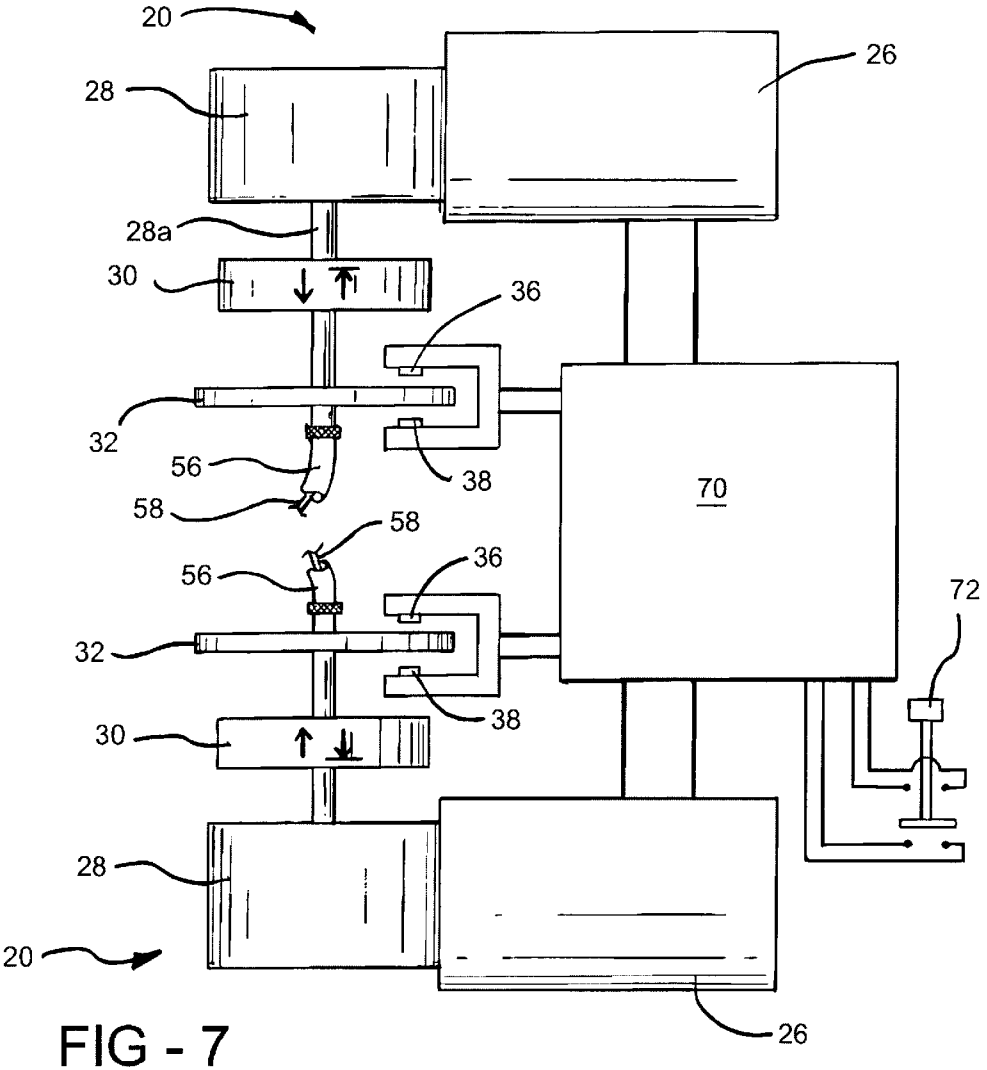
FIG. 7 is a diagrammatic view of the motor assembly and a control circuit.
Figure 6:
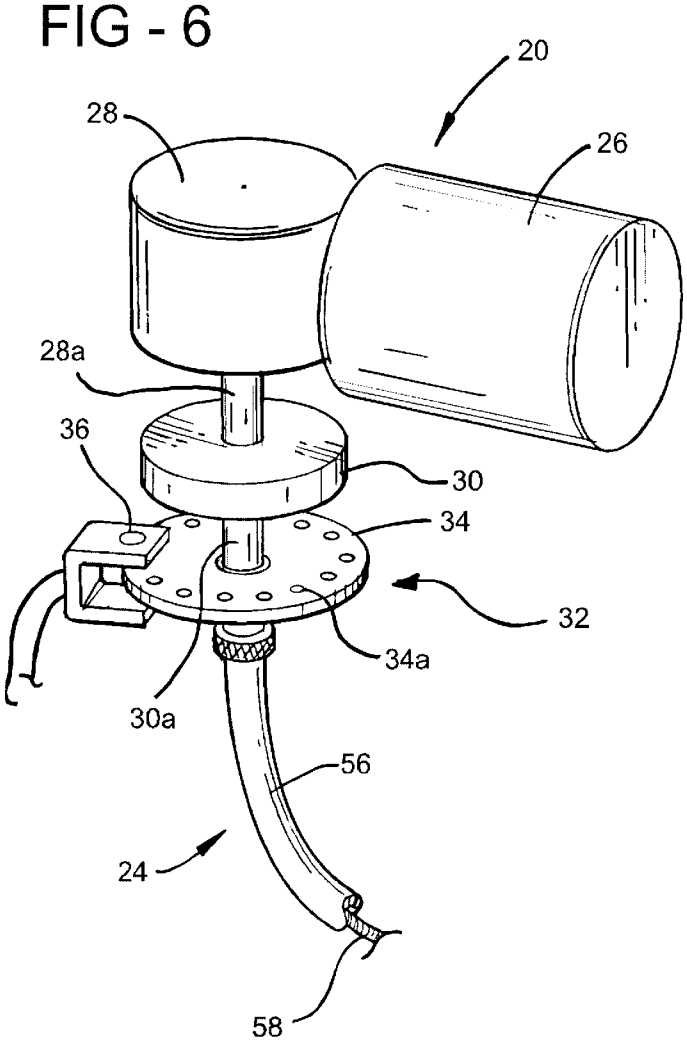
FIG. 6 is a perspective somewhat schematic view of a motor assembly utilized in the invention actuator.

Motor assembly 20 (FIGS. 2, 6, and 7) includes a motor 26, a gear reducer 28, a clutch 30, and an optical encoder 32.

Motor 26 is a direct current fractional horsepower bidirectional electric motor.

Gear reducer 28 receives the output of motor 26 and reduces the speed of the motor in known manner.

Clutch 30 is of known form and provides driving engagement between the output 28*a* of the gear reducer and cable assembly 24 in response to both clockwise and counterclockwise rotation of motor 26 but is ineffective to transmit rotation of the cable assembly 24 to the output of the gear reducer.

Optical encoder 32 is of known form and includes an optical disc 34 driven by the output shaft 30*a* of clutch 30, a transmitter 36, and a receiver 38. Transmitter 36 and receiver 38 coact in known manner to transmit a light beam for selective passage through a circumferentially spaced series of apertures 34*a* in the disc so that the successive appearance of light transmission signals at the receiver is indicative of continued rotation of the disc and the absence or interruption of light transmission signals is indicative of interruption of the disc rotation.

Figure 3:
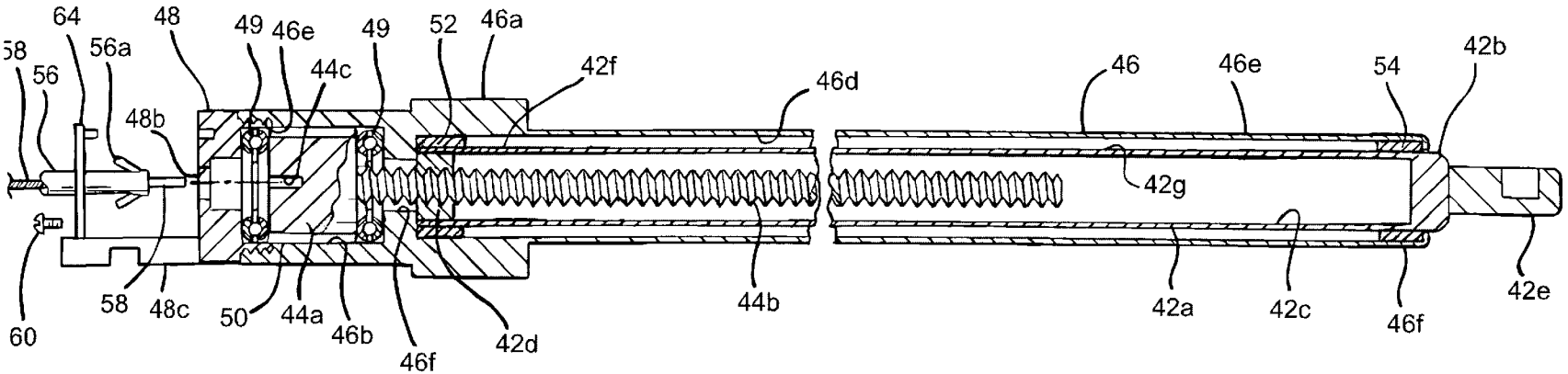
FIG. 3 is a cross-sectional view of a strut utilized in the invention actuator seen in a contracted condition.

Strut assembly 22 (FIGS. 3, 4, and 5) includes a lower tubular housing 40, a tubular extender rod 42, and a lead screw 44. Lower tubular housing 40 and tubular extender rod 42 may have a round cross section, as shown, or may have a non-round cross section.

Lower tubular housing 40 includes a tubular member 46 and an end cap 48.

Tubular member 46 includes an enlarged diameter lower portion 46*a* defining a cavity 46*b,* and an upper tubular main body portion 46*c*. Main body tubular portion 46*c* defines a cylindrical bore 46*d* which extends downwardly into the enlarged diameter portion 46*a* of the tubular housing.

End cap 48 has a threaded portion 48*a* threadably received in a threaded bore 46*e* in the lower end of tubular member 46 whereby the end cap closes the cavity 46*b*. End cap 48 further includes a central aperture 48*b* and a pivotal mounting structure 48*c*.

Tubular extender rod 42 includes a tubular main body portion 42*a,* an upper end 42*b* closing the central bore 42*c* of the rod, a nut structure 42*d* proximate the lower end of the rod, and an upper mounting structure 42*e* at the upper end of the rod.

Lead screw 44 includes a lower enlarged diameter generally cylindrical head portion 44*a* and a threaded shaft portion 44*b* extending upwardly from head portion 44*a*.

Figure 8:
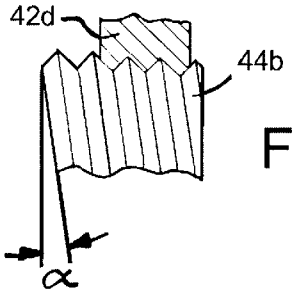
FIG. 8 is a detail view taken within the circle 8 in FIG. 4.

In the assembled relation of the strut 22, head portion 44*a* of lead screw 44 is journaled in cavity 46*b;* shaft portion 44*b* of the lead screw extends upwardly from head portion 44*a* through a central aperture 46*f* in the enlarged diameter lower portion 46*a* to position the threaded shaft portion concentrically within the bore 46*d;* and extender rod 42 is positioned slidably and telescopically within the bore 46*d* in concentric surrounding relation to the shaft portion 44*b* of the lead screw with the nut structure 42*d* threadably engaging the lead screw. The journaling of the head portion 44*a* in cavity 46*b* is facilitated by a pair of thrust bearings 49 positioned at the upper and lower ends of the head portion and by an annular radial bearing 50 positioned in cavity 46*b* in surrounding relation to the head portion. The sliding movement of extender rod 42 in bore 46*d* is facilitated by a first bearing 52 fixedly secured to the lower end 42*f* of extender rod 42 and slidably engaging bore 46*d* and a second annular bearing 54 fixedly secured in the bore 46*d* at the upper end 46*f* of member 46 and slidably engaging the exterior periphery 42*g* of extender rod 42. The threads of lead screw shaft portion 44*b* and nut structure 42*d* have a pitch angle (FIG. 8) of at least 20° so that the lead screw may spin relatively freely in the nut structure to facilitate manual raising and lowering of the gate when necessary and/or desired.

Cable assembly 24 includes a tubular sheath 56 and a central drive core wire 58.

Figure 4:
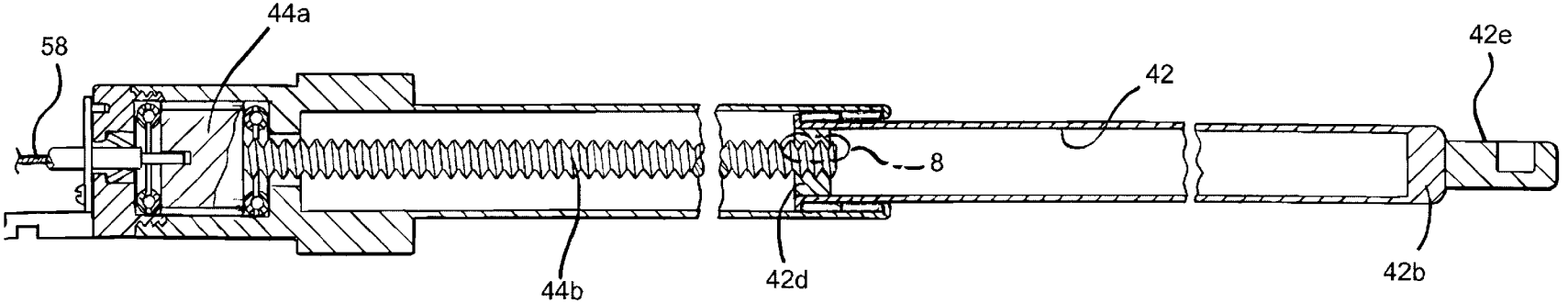
FIG. 4 is a view of the strut seen in an extended condition.
Figure 5:
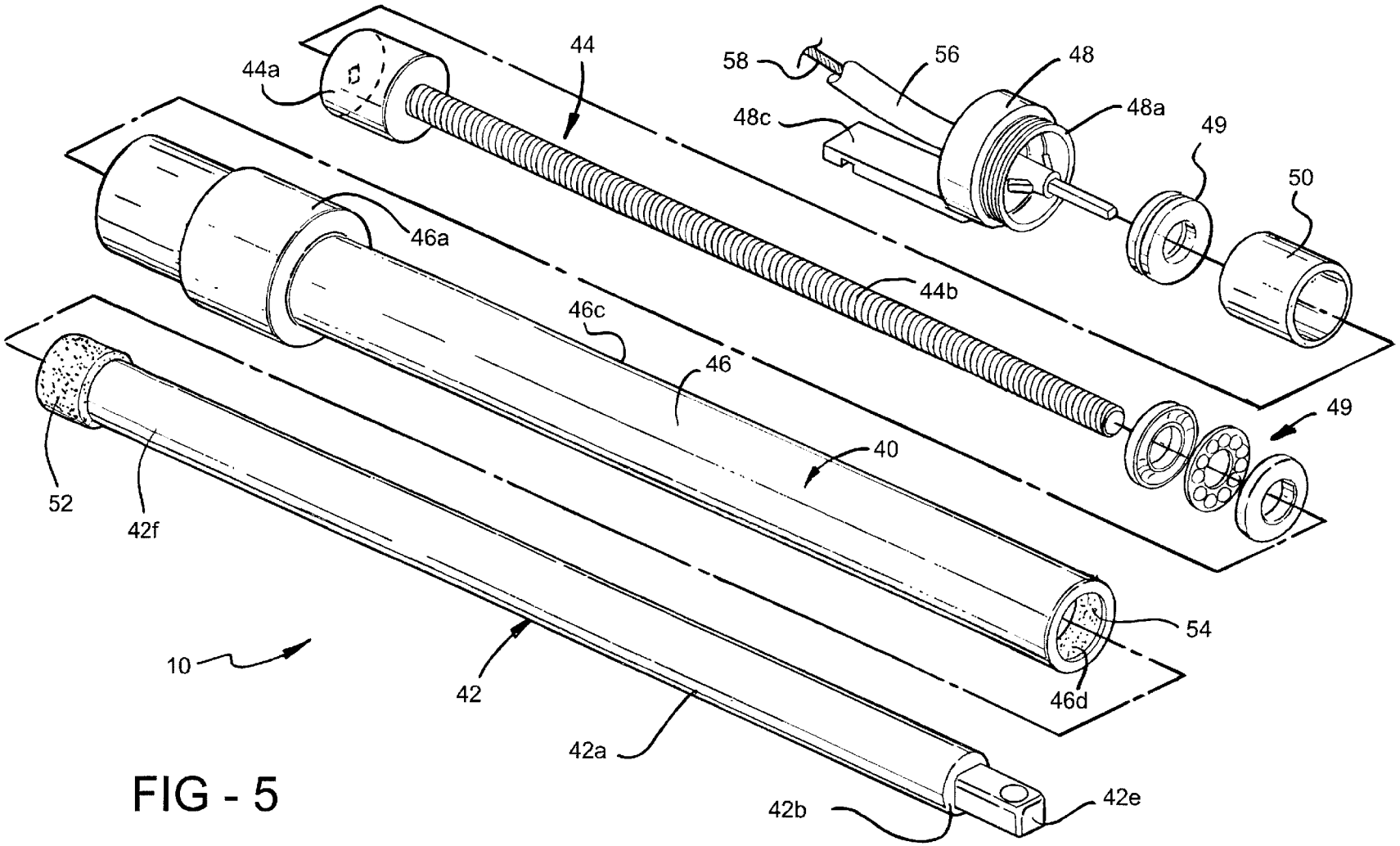
FIG. 5 is a view of the strut in an exploded condition.

When assembled to the motor vehicle body in operative relation to the lift gate 14, each motor assembly 20 is fixedly secured in the rear quarter panel region of the vehicle between an interior trim panel 60 and exterior skin 62; the lower mounting structure 48*c* of each strut is pivotally mounted along an edge 12*b* of the access opening proximate a lower end of the associated gas strut 18; the upper mounting structure 42*e* of each strut is pivotally mounted to a side edge of the lift gate proximate the upper pivotal mounting location of the associated gas strut; and each cable assembly 56 extends from the respective optical encoder 32 to the lower end of the respective strut where the end 56*a* of the sheath passes through aperture 48*b* to position a square driving end 58*a* of the cable core wire in a square receiving socket 44*c* in the head of the respective lead screw 44 whereby rotation of each core wire 58 has the effect of rotating lead screw 44. As the upper end of each cable is passed through aperture 48*b,* prongs 56*a* on the sheath flex inwardly to allow passage of the cable through the aperture and then flex outwardly as seen in FIG. 4 to capture the cable end within the aperture and preclude inadvertent withdrawal of the cable. The position of each cable is further secured by an end plate 64 fixedly secured to the sheath of the cable assembly and fastened to the lower end of end cap 48 utilizing fasteners 66.

Operation

When it is desired to lift the tailgate from the closed position of FIG. 2 to the raised or open position of FIG. 1, each motor 26 is energized in a sense to rotate the core wire 58 of the respective cable assembly 24 in a direction to rotate the respective lead screw 44 in a sense to move the respective extender rod 42 upwardly along the threaded shaft portion 44*b* of the lead screw and extend the strut to thereby move the gate to its open position. The gas struts 18 assist the actuator in this upward movement. When it is desired to lower the lift gate to the closed position, the motors are actuated in a reverse sense to rotate the cable core in a reverse sense to rotate the lead screws 44 in a reverse sense so that the extender rods 42 move downwardly along the threaded shaft portion of the lead screw to the collapsed position seen in FIG. 3, whereby to lower the gate.

It will be understood that suitable control circuitry will be provided to maximize the smooth and safe operation of the gate. For example, and as seen schematically in FIG. 7, a controller 70 may be provided to act in coaction with the optical encoders 32 and with a manual switch 72 provided on the instrument panel of the motor vehicle. Switch 72 may be arranged to energize the motors either in an opening or a closing sense, acting through controller 70, and optical encoders 32 may monitor the opening and closing movement of the gate to ensure that no obstacle is encountered. Specifically, discs 34 rotate as the gate is raised and lowered and any interruption in the light transmitted between transmitters 36 and receivers 38 as perceived through the apertures 34*a* in the discs will result in the generation of an abort signal to the motors via the controller 70. It will further be understood that actuation of the switch 72 in a sense to open the lift gate would also function via the controller to unlatch the gate prior to the commencement of the lifting movement of the gate, and a cinching latch mechanism of known form would be provided to move the gate into a firmly latched position as the gate approaches the fully closed position.

In the event of failure of the power mechanism, or a decision to not employ the power mechanism, the gate, by virtue of the large pitch angle of the threads of the lead screw shaft portion and the nut structure, may be readily raised or lowered manually. During manual raising or lowering, clutch 30 is ineffective to transmit rotation of the cable assembly to the output of the gear reducer so as not to back drive the motor.

The actuator of the invention will be seen to provide many important advantages. Specifically, the actuator acts to efficiently and rapidly open and close the gate; the actuator is simple and inexpensive in construction; the actuator is reliable in operation but extremely durable whereby to minimize maintenance cost and optimize product life and the actuator requires no redesign of the existing body structure for a typical van type motor vehicle.

Whereas a preferred embodiment of the invention has been illustrated and described in detail, it will be apparent that various changes may be made in the disclosed embodiment without departing from the scope or spirit of the invention. For example, although the invention has been described as utilizing separate left and right actuators associated with the left and right aspects of the gate, in some applications effective opening and closing movement of the gate may be achieved using only a single actuator. Further, although the actuator has been described in the context of a power actuator, it is envisioned that the actuator might also be used in a manual environment wherein the rotary movement of the lead screw might be provided utilizing a handle or the like.

What is claimed is:

1. A power actuator for lifting a pivotal lift gate closing an access opening in a motor vehicle body, the power actuator comprising:

a motor assembly adapted to be fixedly secured to the motor vehicle body proximate the access opening;

an elongated flexible cable mounted for rotation about a lengthwise axis of the cable and having a driven end driven by the motor assembly and a driving end; and an extensible strut detached from and positioned remotely from the motor assembly and operatively interconnected to the motor assembly by the elongated cable, the strut including:

an upper mounting structure proximate an upper end of the strut for pivotally mounting the upper end of the strut to the lift gate;

a lower mounting structure proximate a lower end of the strut for pivotally mounting the lower end of the strut to the motor vehicle body proximate the access opening;

means proximate the lower end of the strut for receiving the driving end of the cable; and means for extending the strut in response to rotation of the cable by the motor assembly whereby to raise the gate in response to actuation of the motor assembly.

2. A power actuator according to claim 1 wherein:

the extensible strut includes a lower tubular housing member, said extending means comprises a lead screw mounted for rotation in the tubular housing member and including a lower head portion journaled in a lower portion of the tubular housing member and an upper threaded shaft portion, said strut further including a tubular extender rod telescopically and slidably positioned in the tubular housing member in concentric surrounding relation to the lead screw shaft portion and including a nut structure at a lower end thereof threadably receiving the lead screw shaft portion;

the lower mounting structure is provided proximate the lower portion of the tubular housing member; and the upper mounting structure is provided proximate an upper end of the tubular extender rod.

3. A power actuator according to claim 2 wherein:

the lower portion of the tubular housing member defines a cavity;

the head portion of the lead screw is journaled in the cavity;

the receiving means includes an aperture in the lower portion of the tubular housing member communicating with the cavity; and the driving end of the cable passes through the aperture and drivingly engages the head portion of the lead screw.

4. A power actuator according to claim 3 wherein the actuator further includes a bearing structure positioned in the cavity and journaling the lead screw head portion.

5. A power actuator according to claim 2 wherein threads of the lead screw shaft portion and of the nut structure have a pitch angle of at least 20° so that the lead screw may spin freely in the nut structure as the gate is raised and lowered manually so as to offer minimal resistance to the manual raising and lowering of the gate.

6. A power actuator according to claim 5 wherein the motor assembly includes a motor and a clutch downstream of the motor effective to drive the cable from the motor but ineffective to drive the motor from the cable, for avoiding back driving of the motor in response to the manual operation of the lift gate.

7. A power actuator according to claim 1 wherein the motor assembly includes an electric motor and a speed reducer driven by the motor.

8. A power actuator for lifting a pivotal lift gate closing an access opening in a motor vehicle body, the actuator comprising:

a motor assembly adapted to be fixedly secured to the motor vehicle body proximate the access opening and having an output;

a lower tubular housing member adapted to be pivotally mounted at a lower end thereof to the motor vehicle body proximate the access opening but remote from the motor assembly output;

a lead screw mounted for rotation in the lower housing member and including a lower head portion journaled in a lower portion of the lower housing member and an upper threaded shaft portion;

a tubular extender rod telescopically and slidably positioned in the lower housing member in concentric surrounding relation to the lead screw shaft portion, the extender rod including a nut structure at a lower end thereof threadably receiving the lead screw shaft portion and adapted to be pivotally secured at an upper end thereof to the lift gate; and an elongated flexible cable mounted for rotation about a lengthwise axis of the cable and interconnecting the output of the motor assembly and the head portion of the lead screw, wherein actuation of the motor assembly rotates the cable to rotate the lead screw to extend the tubular extender rod.

9. A power actuator according to claim 8 wherein threads of the lead screw shaft portion and of the nut structure have a pitch angle of at least 20° so that the lead screw may spin freely in the nut structure as the gate is raised and lowered manually so as to offer minimal resistance to the manual raising and lowering of the gate.

10. A power actuator according to claim 9 wherein the motor assembly includes a motor and a clutch downstream of the motor effective to drive the cable from the motor but ineffective to drive the motor from the cable for avoiding driving of the motor in response to the manual operation of the gate.

11. A power actuator according to claim 8 wherein:

the lower end of the tubular housing member includes a cavity and an aperture communicating with the cavity;

the head portion of the lead screw is journaled in the cavity; and the cable extends through the aperture and drivingly engages the head portion of the lead screw.

12. An actuator for providing relative movement between first and second structures, the actuator comprising:

a lower tubular housing;

a lead screw having a lower head portion journaled in a lower portion of the tubular housing and a threaded shaft portion extending upwardly from the head portion within the tubular housing;

a tubular extender rod positioned slidably and telescopically within the tubular housing in concentric surrounding relation to the shaft portion of the lead screw and including a nut structure proximate a lower end thereof threadably engaging the shaft portion of the lead screw;

a mounting structure on the tubular housing for mounting the tubular housing on the first structure;

a mounting structure on the tubular extender rod for mounting the tubular extender rod on the second structure; and a flexible elongated cable extending through an aperture in the lower portion of the lower tubular housing and directly drivingly engaging the head portion of the lead screw, wherein rotation of the cable rotates the lead screw relative to the tubular housing to extend the tubular extender rod axially relative to the tubular housing for providing relative movement between the first and second structures.

13. An actuator according to claim 12 wherein:

the mounting structure on the tubular housing is provided proximate a lower end of the tubular housing; and the mounting structure on the tubular extender rod is provided proximate an upper end of the tubular extender rod.

14. An actuator according to claim 13 wherein the mounting structures are pivotal mounting structures.

15. An actuator according to claim 12 wherein the actuator further includes a bearing structure journaling the head portion of the lead screw.

16. An actuator according to claim 15 wherein the bearing structure comprises a radial bearing structure and a thrust bearing structure.

17. An actuator according to claim 12 wherein the actuator further includes an electric motor driving the flexible cable. cable.

18. An actuator according to claim 12 wherein:

the tubular housing includes a lower end wall structure; and the aperture is provided in the lower end wall structure.

19. An actuator according to claim 12 wherein the actuator further includes a bearing structure between an interior surface of the tubular housing and an exterior surface of the tubular extender rod to facilitate sliding telescopic movement of the tubular extender rod relative to the tubular housing.

* * * * *